US012421822B1

(12) United States Patent
Rohr

(10) Patent No.: US 12,421,822 B1
(45) Date of Patent: Sep. 23, 2025

(54) WIRELINE CABLE CUTTING RELEASE

(71) Applicant: Schlumberger Technology Corporation, Sugar Land, TX (US)

(72) Inventor: William Rohr, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/761,761

(22) Filed: Jul. 2, 2024

(51) Int. Cl.
*E21B 29/04* (2006.01)

(52) U.S. Cl.
CPC ..... *E21B 29/04* (2013.01)

(58) Field of Classification Search
CPC ..... E21B 29/04
See application file for complete search history.

(56) References Cited

U.S. PATENT DOCUMENTS 4,237,972 A * 12/1980 Lanmon, II ..... B23D 15/145 166/54.5
2002/0152856 A1* 10/2002 Brumley ..... E21B 29/04 83/13
2005/0230115 A1* 10/2005 Rose ..... E21B 17/026 166/301
2015/0083386 A1* 3/2015 Wells ..... E21B 29/04 166/54.5
2020/0217148 A1* 7/2020 Massey ..... E21B 17/028
2022/0145716 A1* 5/2022 Kleinschmit ..... E21B 17/026
2023/0115354 A1* 4/2023 Rasmussen ..... E21B 29/005 166/54.6
2023/0203903 A1* 6/2023 Evans ..... E21B 29/02 166/377

FOREIGN PATENT DOCUMENTS

WO 2023205178 A1 10/2023

* cited by examiner

*Primary Examiner* — Taras P Bemko
(74) *Attorney, Agent, or Firm* — Jeffrey D. Frantz

(57) ABSTRACT

Examples herein include systems and methods for severing a cable to retrieve the cable while leaving the head and downhole tool in a wellbore. A cable cutting device for severing a cable configured to provide support in a well includes a head, a rope socket assembly configured to engage an end of the cable and configured to be at least partially supported by the cable, the rope socket assembly positioned within the head, an actuator device that selectively secures or releases the rope socket assembly relative to the head, and a cutting blade configured to cut the cable. The cutting blade secured in an open position when the actuator device selectively secures the rope socket assembly relative to the head, and the cutting blade biased to a closed position by a tension force in the cable when the actuator device selectively releases the rope socket assembly relative to the head.

14 Claims, 5 Drawing Sheets

WIRELINE CABLE CUTTING RELEASE

TECHNICAL FIELD

In the oil and gas industry, wireline cables are used to lower downhole tools into a wellbore to perform various services.

BACKGROUND

A wireline cable (also referred to herein as a "wireline" or "cable" herein) can include electrical cabling capable of conveying power and data, to control tools and acquire real-time data from their operation. A wireline cable can also include strengthening elements such as armored cabling that not only protects the wireline but also provides tensile strength for supporting a tool as it is raised or lowered within a wellbore.

SUMMARY

In one independent aspect, a cable cutting device for severing a cable configured to provide support in a well includes a head including a ramped channel in an outer wall of the head; a housing movable relative to the head and configured to be at least partially supported by the cable, the housing including a rope socket configured to engage an end of the cable; a cutting blade supported by the housing and coupled to the ramped channel, the cutting blade movable along the ramped channel as the housing moves relative to the head; and an actuator device for selectively securing the housing to the head, the cutting blade secured in an open position while the actuator device selectively secures the housing to the head, and the cutting blade biased to a closed position when the actuator device selectively releases the housing from the head.

In some aspects, a tension force in the cable biases the housing to move relative to the head.

In some aspects, the ramped channel is one of a plurality of ramped channels, and the cutting blade is one of a plurality of cutting blades each pinned to a corresponding one of the plurality of ramped channels.

In some aspects, the cutting blade is coupled to rollers that can roll along the ramped channel.

In some aspects, the ramped channel includes a lower end and an upper end, the lower end is located a first radial distance from a central axis of the head and the upper end is located a second radial distance from the central axis of the head, and the first radial distance is greater than the second radial distance.

In some aspects, the cutting blade is coupled to the lower end of the ramped channel when the actuator device selectively secures the housing to the head.

In another independent aspect, a cable cutting device for severing a cable configured to provide support in a well includes a head; a rope socket assembly configured to engage an end of the cable and configured to be at least partially supported by the cable, the rope socket assembly positioned within the head; an actuator device for selectively securing or releasing the rope socket assembly relative to the head; and a cutting blade configured to cut the cable, the cutting blade secured in an open position when the actuator device selectively secures the rope socket assembly relative to the head, and the cutting blade biased to a closed position by a tension force in the cable when the actuator device selectively releases the rope socket assembly relative to the head.

In some aspects, the tension force in the cable biases the rope socket assembly in a first direction towards an upper end of the head, and movement of the rope socket assembly in the first direction biases the cutting blade to the closed position.

In some aspects, the cutting blade is coupled to a ramped channel.

In some aspects, the ramped channel includes a lower end and an upper end, the lower end is located a first radial distance from a central axis of the head and the upper end is located a second radial distance from the central axis of the head, the first radial distance is greater than the second radial distance, and the cutting blade is coupled to the lower end of the ramped channel when the actuator device selectively secures the rope socket assembly to the head.

In some aspects, the rope socket assembly engages a linkage arm to bias the cutting blade to the closed position when the rope socket assembly moves in the first direction.

In some aspects, the cutting blade is pivotally connected to the linkage arm, and a portion of the cutting blade engages a wall that forces the cutting blade to pivot closed as the linkage arm moves.

In some aspects, the rope socket assembly includes a rope socket and a rope socket housing, the actuator device selectively securing or releasing the rope socket relative to the head by selectively securing or releasing the rope socket housing relative to the head.

In some aspects, the actuator device includes a first portion fixed to the rope socket housing and a second portion fixed to the head, and the first portion can be selectively secured to or released from the second portion.

In some aspects, the rope socket assembly is retained within the head when the rope socket assembly is released relative to the head, and at least a portion of the cable is released from the head.

In yet another independent aspect, a cable cutting device is provided for severing a cable engaging a rope socket assembly, the cable configured to provide support in a well. The cable cutting device includes a head at least partially supported by the cable; a first linkage arm pivotally coupled to the head; a second linkage arm pivotally coupled to the rope socket assembly, the second linkage arm further pivotally coupled to the first linkage arm at an intermediate connection; an actuator device selectively operable between a first state in which the rope socket assembly is secured relative to the head, and a second state in which the rope socket assembly is released relative to the head; and a cutting blade coupled to the intermediate connection, the cutting blade secured in an open position while the actuator device is in the first state, the cutting blade biased to a closed position while the actuator device is in the second state.

In some aspects, a tension force in the cable biases the rope socket assembly in a first direction towards an upper end of the head, and movement of the rope socket assembly biases the intermediate connection radially inwards to move the cutting the cutting blade to the closed position.

In some aspects, the cutting blade has an elongated slot for coupling to the intermediate connection.

In some aspects, the cutting blade is received within a slot in the rope socket assembly such that movement of the rope socket assembly in a first direction towards an upper end of the head biases movement of the cutting blade in the first direction, the elongated slot permits the cutting blade to move relative to the intermediate connection in a direction parallel to the first direction, and the intermediate connection biases the cutting blade to move in a second direction perpendicular to the first direction.

In some aspects, the first linkage arm is pivotally coupled to the head at a first connection, the second linkage arm is pivotally coupled to the rope socket assembly at a second connection, and the second connection moves away from the first connection when the rope socket assembly moves in a first direction towards an upper end of the head.

Other aspects will become apparent by consideration of the detailed description and accompanying drawings.

DETAILED DESCRIPTION

Figure 1:
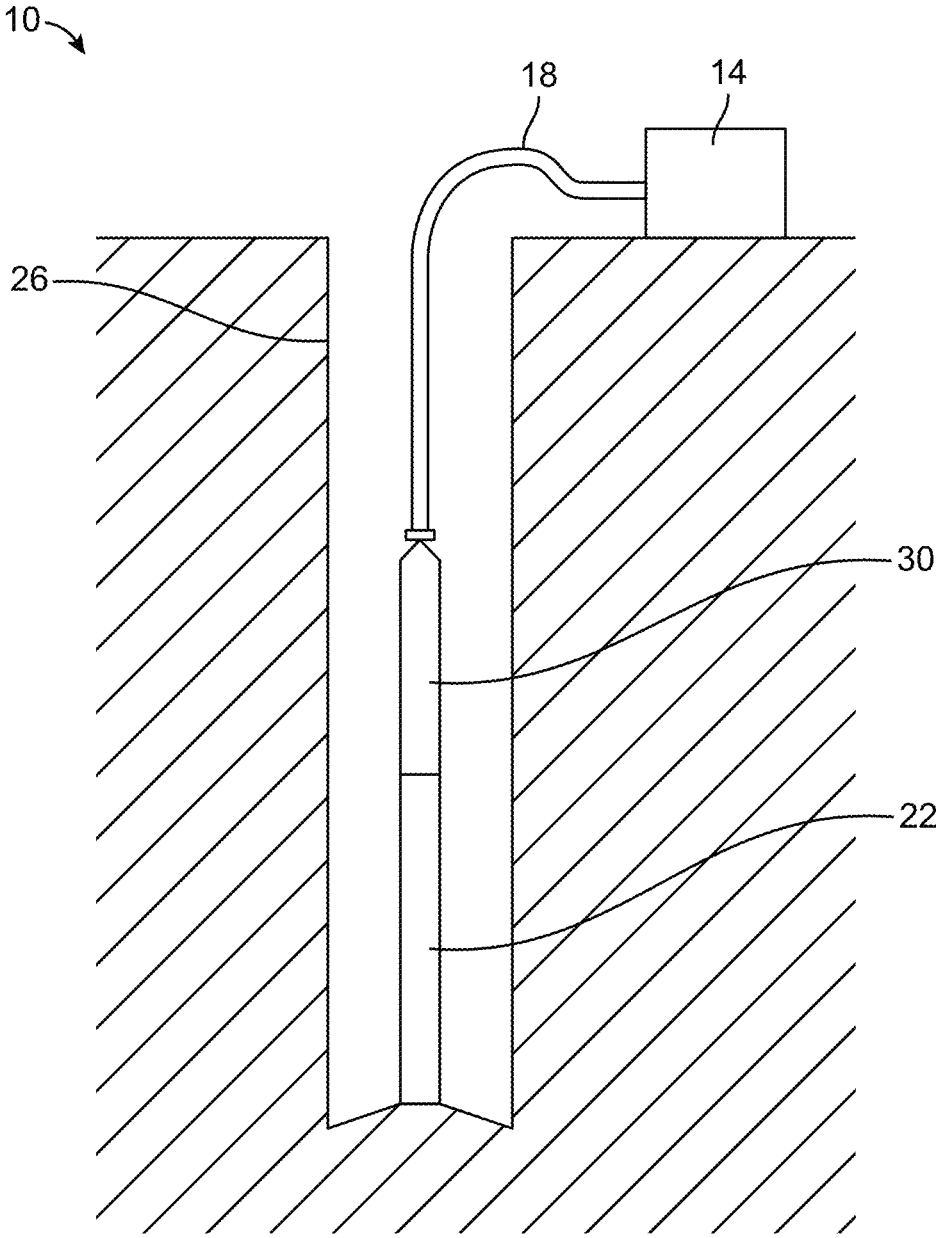
FIG. 1 is an illustration of a tool positioned within a wellbore using a wireline connected to the tool by an exemplary wireline head.

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof, as well as possible additional items. Unless specified or limited otherwise, the terms "mounted," "connected," "supported," and "coupled" and variations thereof are used broadly and encompass both direct and indirect mountings, connections, supports, and couplings.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

A wireline cable is typically terminated both electrically and mechanically via a cable termination. A wireline head is then typically used to contain the cable termination and connect the cable to a downhole tool. A wireline head with cable termination refers to a mechanical and electrical coupling that securely terminates or secures the cable and allows for connection to a tool. Cable termination can include any type of mechanical cable connection and does not imply that the entire cable ends at the termination location rather, at least some of the cable, such as the portion that carries power and data, can continue past the termination location such that it can interface with a tool as necessary.

A wireline cable typically consists of inner and armor wires which carry the tensile load of the cable. The cable is mechanically terminated using a rope socket, which may trap these armor wires between cones. These cones are hammered into place and seat on the cable armors via the deformation of the cone or armor materials and friction allowing for the tensile load to be transferred through the rope socket into the wireline head.

Wireline tools can become stuck, resulting in costly fishing operations and/or abandonment of tools and sections of the well. Release devices are used to increase the likelihood of retrieving tools. Some release devices cause the tool string to separate between tools or within the wireline head, typically leaving a portion of tools or components attached to the wireline cable. A clean cable release, where the cable separates from all downhole components, is sometimes preferred as it allows the cable to be retrieved from the well without the added risk of the attached components potentially becoming stuck after release and/or damaged at the well head.

As shown in FIG. 1 an exemplary system 10 for wireline systems includes wireline surface equipment 14 and an associated with a cable, such as a slickline or wireline cable 18. The wireline surface equipment 14 can include any components necessary to operate a wireline cable 18. For example, the equipment 14 can include mechanical components for controlling the wireline 18, such as a spool or reel upon which the wireline cable 18 is wound, and a motor that rotates the spool or reel to wind and unwind the wireline cable 18. The wireline surface equipment 14 can also include various electrical components, such as a control system. The control system can, for example, control the winding and unwinding of a wireline spool or the operation of a tool 22, either automatically or based on operator input. The control system of the wireline surface equipment 14 can include one or more computing devices, such as a computer, smartphone, or tablet. The equipment 14 can also include a power source that provides power to the wireline 18. The equipment 14 can also send and receive data through the wireline cable 18.

In some examples, wireline cable 18 can include multi-conductor lines and single-conductor lines that can be used with equipment that is inside a wellbore 26. The wellbore 26 can include a hole that is drilled to aid in the exploration and recovery of natural resources, including oil, gas, or water. In some examples, multi-conductor lines can include external armor wires wound around a core of multiple conductors. The conductors can be bound together in a central core, protected by the outer armor wires. The conductors can transmit power to the downhole instrumentation and transmit data to and from the surface equipment 14 (e.g., computers, mobile devices, and the like). In other aspects, the single conductor cables can be similar in construction to multi-conductor cables but can only have one conductor. In other aspects, single-conductor cables can be used for well construction activities such as pipe recovery, perforating and plug setting as well as production logging and reservoir production characterization.

Retraction or extension of the wireline cable 18 can physically raise or lower a tool 22 within the wellbore 26, for example by operating the wireline surface equipment 14 to reel the cable 18 in or out. The wireline cable 18 can also provide power and data lines to the tool 22. A wireline head 30 may attach the wireline cable 18 to the tool 22. As explained in more detail with respect to the remaining drawings, the wireline head 30 can include a rope socket 34 (FIG. 2) that terminates, or secures, the wireline cable 18 within the wireline head 30. The wireline head 30 can also detachably couple to the tool 22, providing a mechanical and electrical connection between the wireline cable 18 and the tool 22.

The wireline cable 18 can be removed from the wireline head 30 by implementing the devices and methods disclosed herein, including those associated with the following disclosure.

Figure 2:
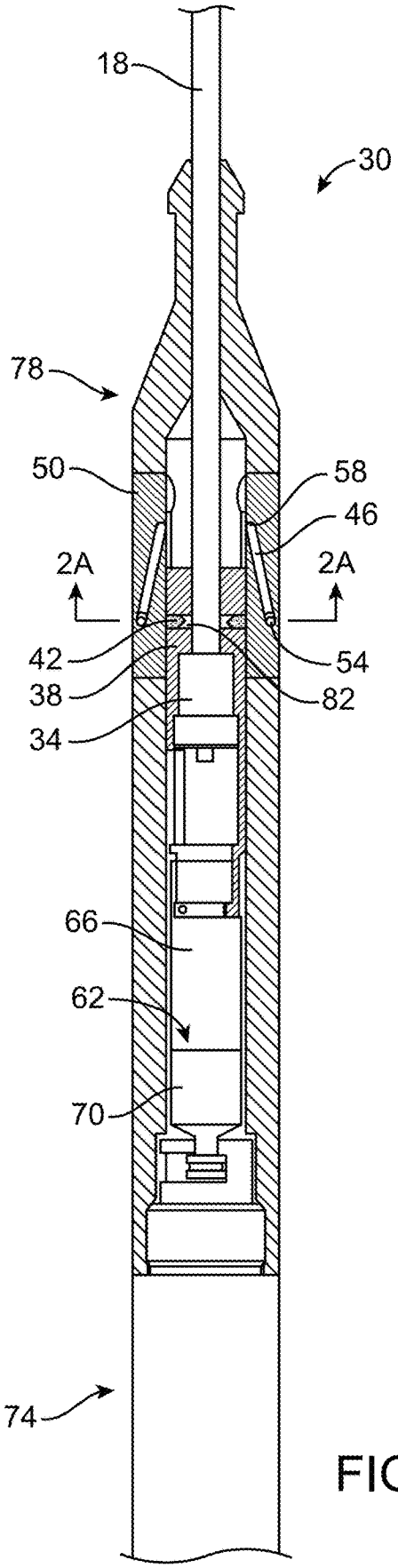
FIG. 2 is a side cross-sectional view of a portion of the wireline head and wireline.
Figure 3:
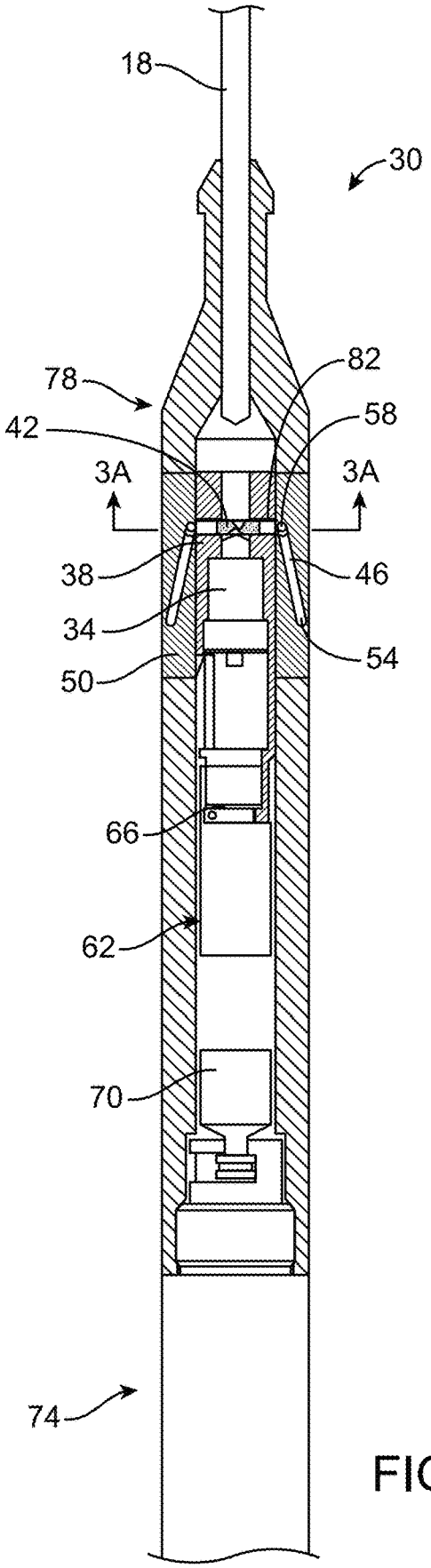
FIG. 3 is a side cross-sectional view of a portion of the wireline head and wireline of FIG. 2 shown with the wireline cut.

As shown in FIGS. 2 and 3, the wireline cable 18 includes a rope socket 34 that receives and secures or terminates an end of the wireline cable 18. The rope socket 34 may be received in or coupled to a rope socket carrier or housing 38 within the wireline head 30. The rope socket housing 38 may include a cutting mechanism (e.g., cutting blades 42) for cutting the wireline cable 18. As shown in FIG. 2, the cutting blade(s) 42 are open and do not engage the wireline cable 18 when the rope socket housing 38 is held in a lower position within the wireline head 30.

Figure 2A:
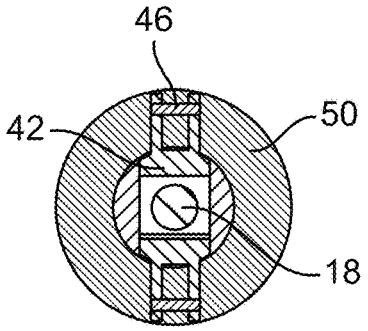
FIG. 2A is cross-sectional view of the wireline head viewed along section 2A-2A as indicated in FIG. 2.
Figure 3A:
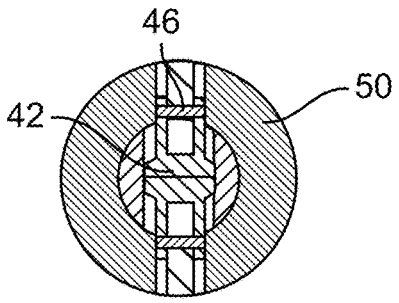
FIG. 3A is cross-sectional view of the wireline head viewed along section 3A-3A as indicated in FIG. 3.

The cutting blades 42 may be pinned within a ramped channel 46 such that the cutting blades 42 close or are actuated towards each other as the rope socket housing 38 and cutting blades 42 move upwards within the wireline head 30. For example, the cutting blades 42 may be coupled to rollers received within the ramped channel 46. The ramped channel 46 may be formed in the outer wall 50 of the wireline head 30 and may be angled such that the cutting blades 42 are in a fully open position when at a lower end 54 of the ramped channel 46 (see FIGS. 2 and 2A) and the cutting blades 42 are in a fully closed or engaged position when at an upper end 58 of the ramped channel 46 (see FIGS. 3 and 3A). That is, the lower end 54 of the ramped channel 46 may be located a greater radial distance from a central axis of the wireline head 30 than the upper end 58 of the ramped channel 46. As shown in FIG. 3, the cutting blades 42 are closed and have cut through the wireline cable 18 such that the wireline cable 18 can be released from the wireline head 30 while the rope socket 34 is retained within the wireline head 30.

To control when the wireline cable 18 is cut or released, the rope socket housing 38 may be coupled or attached to a lock/unlock mechanism or actuator device 62. The actuator device 62 can hold the rope socket housing 38 in a lower position (e.g., when the tool 22 is in use) and can selectively release the rope socket housing 38 from being connected to the wireline head 30 (e.g., when the tool 22 is stuck or the wireline cable 18 is otherwise desired to be retrieved to the surface). As shown in FIGS. 2 and 3, the actuator device 62 may be an electronically controlled release device (ECRD) that includes a separating portion 66 coupled to rope socket housing 38 and a secured portion 70 coupled to the wireline head 30. The ECRD actuator device 62 may be selectively actuated to release the separating portion 66 from the secured portion 70, which thereby releases the rope socket housing 38 from the wireline head 30. The actuator device 62 may be controlled based on signals transmitted via the wireline cable 18. In some embodiments, as shown, the secured portion 70 is coupled to a lower housing 74 of the wireline head 30, and the separating portion 66 and rope socket housing 38 are received within an upper housing 78 of the wireline head 30. In other embodiments, the secured portion 70 may be coupled to the upper housing 78.

When the actuator device 62 selectively releases the rope socket housing 38, gravity can pull the wireline head 30 downward relative to the rope socket housing 38 that remains coupled to the wireline cable 18 via the rope socket 34. Put another way, the wireline cable 18 and rope socket housing 38 can be pulled upwards under tension of the wireline cable 18 relative to the wireline head 30 (e.g., in the event the wireline head 30 is stuck in the wellbore 26) As the rope socket housing 38 moves upward moves upward relative to the wireline head 30, the cutting blades 42 are forced inwards by the ramped channel 46 until the cutting blades 42 either fully cut the wireline cable 18 or weaken the wireline cable 18 until it breaks under tension (e.g., due to the outer armor being cut or the wireline cable 18 being pinched to a weakened state). Accordingly, a closed position or "cutting position" of the cutting blades 42 does not require that the cutting blades 42 fully close to the point of contacting each other or reaching the end position of travel. A closed position that is only 80%, 60%, 40%, 20%, or even 10% of "fully closed" may be sufficient to cut and weaken the wireline cable 18 enough to break the wireline cable 18 and release it from the wireline head 30.

As shown in the illustrated embodiments, two cutting blades 42 may be positioned opposite each other. The cutting blades 42 may be slightly offset in the vertical such that the leading edges of the cutting blades 42 may overlap when in the fully closed position thereby increasing the "cutting depth." In other embodiments, fewer or more cutting blades 42 may be provided.

As illustrated in FIGS. 2 and 3, the cutting blades 42 can be pinned within a ramped channel 46 and the rope socket housing 38 may receive the cutting blades 42 within openings or slots 82 that engage and move the cutting blades 42 with rope socket housing 38. That is, the slots 82 carry and move the cutting blades 42 in a direction parallel to a central axis of the wireline head 30 (e.g., generally the direction the wireline cable 18 is extended) while permitting freedom of movement of the cutting blades 42 to open or close in a direction perpendicular to the central axis of the wireline head 30 (e.g., open or close in a radial direction).

Figure 4:
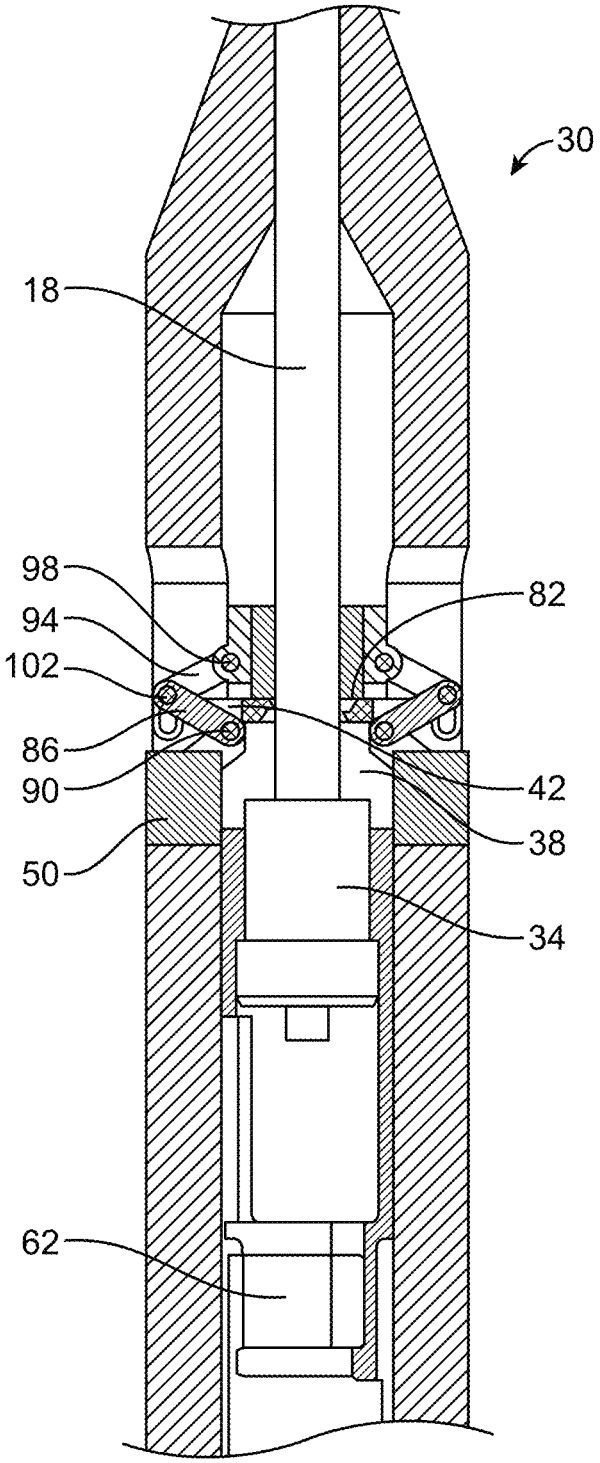
FIG. 4 is a side cross-sectional view of a portion of a wireline head and wireline according to another embodiment.
Figure 5:
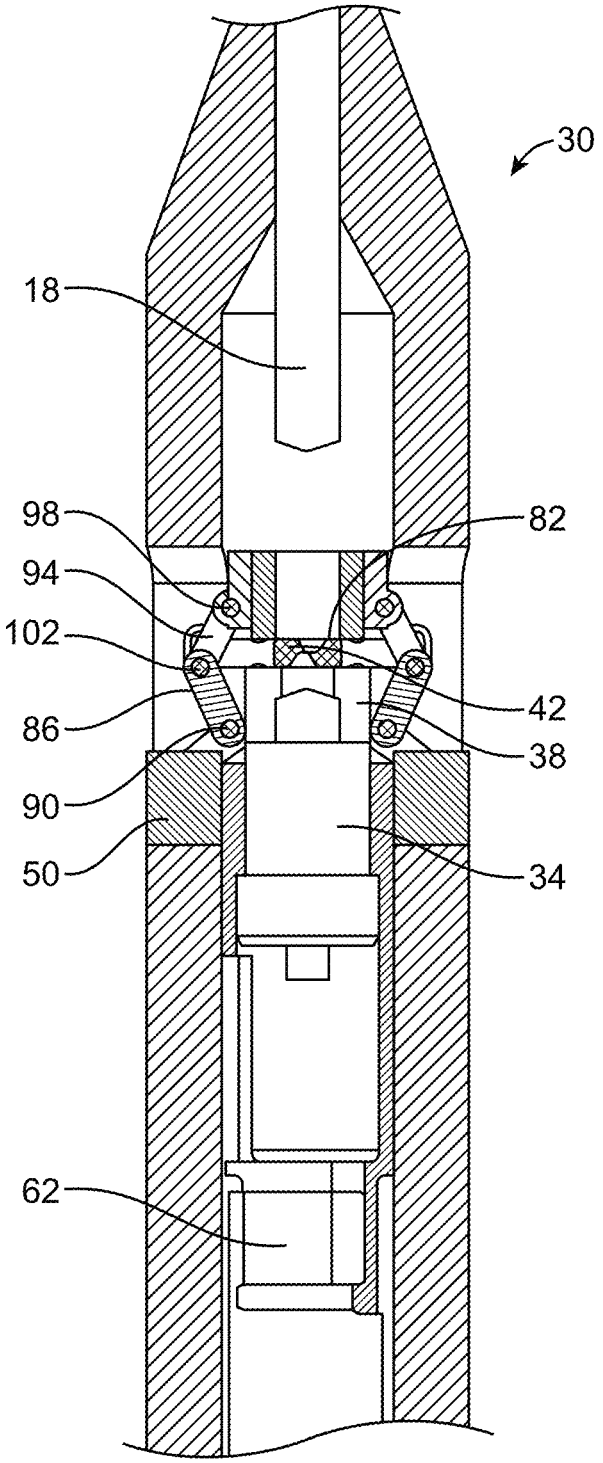
FIG. 5 is a side cross-sectional view of a portion of the wireline head and wireline of FIG. 4 shown with the wireline cut.

In other embodiments, the cutting blades 42 may be actuated between open and closed positions by a linkage arm system. For example, as shown in FIGS. 4 and 5, a first linkage arm 86 may be pivotally coupled to a portion of the wireline head 30, such as the outer wall 50 or another component fixed to the wireline head 30, at a first connection 90. A second linkage arm 94 may be pivotally coupled to the rope socket housing 38 (as shown) or otherwise coupled to the rope socket 34 at a second connection 98. The first linkage arm 86 and second linkage arm 94 may also be pivotally coupled to each other at an intermediate connection 102, and the cutting blade 42 may be fixed or pinned to the intermediate connection 102. For example, pins may extend through apertures of the linkage arms 86, 94 to pivotally couple the linkage arms 86, 94 at the connections 90, 98, 102 while still allowing the linkage arms 86, 94 to rotate about the pins. The cutting blade 42 may be coupled to the pin at the intermediate connection 102 such that movement of the linkage arms 86, 94 results in movement of the cutting blade 42.

As shown in FIG. 4, when the actuator device 62 secures the rope socket housing 38 in a lower position, the first connection 90 and second connection 98 are held in a fixed position such that the linkage arms 86, 94 must extend outwardly to maintain the intermediate connection 102 between the linkage arms 86, 94. This holds the cutting blade 42 in an open position. As shown in FIG. 5, when the actuator device 62 releases the rope socket housing 38 permitting the rope socket housing 38 to move upwards relative to the wireline head 30, the second connection 98 likewise moves upwards while the first connection 90 remains fixed. This causes the linkage arms 86, 94 to "flatten" and the intermediate connection 102 to move inwards such that the cutting blade 42 is moved to a closed position.

Figure 4A:
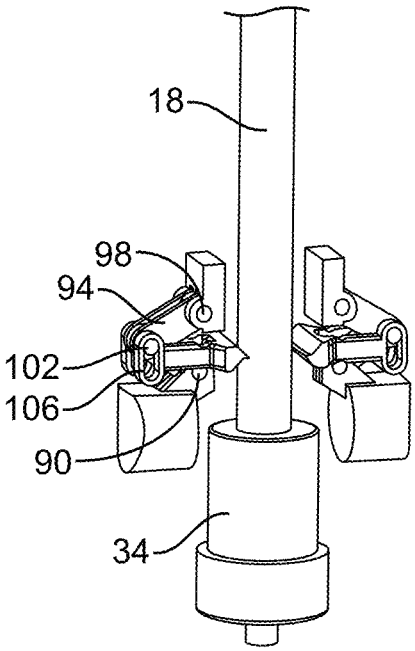
FIG. 4A is perspective view of components of the wireline head and wireline of FIG. 4.
Figure 5A:
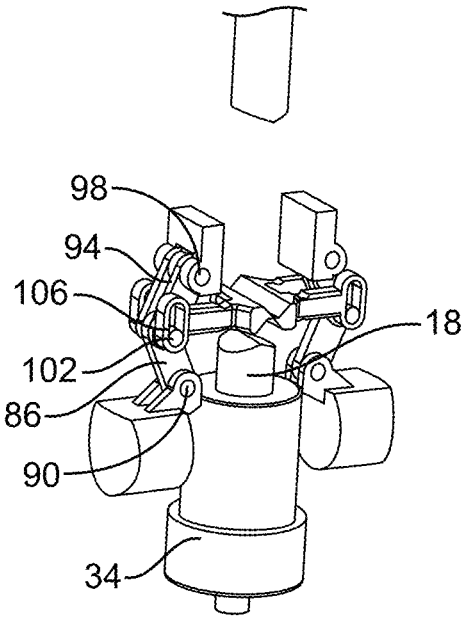
FIG. 5A is perspective view of components of the wireline head and wireline of FIG. 5.

The cutting blade 42 may be secured in the slot 82 of the rope socket housing 38 to ensure the cutting blade 42 travels inwardly instead of rotating or moving in an undesired direction. As best shown in FIGS. 4A and 5A, the cutting blade 42 may include an elongated slot 106 for pivotally connecting to the intermediate connection 102 (e.g., pin of the intermediate connection 102 extends through the elongated slot 106). The elongated slot 106 can accommodate differences in linear distance traveled by the intermediate connection 102 compared to the slot 82 of the rope socket housing 38. The distance the intermediate connection 102 travels parallel to the central axis may be less than the distance the slot 82 travels, so the elongated slot 106 permits some "play" to reduce binding and/or misalignment of the cutting blade 42. In other embodiments, a different mechanism could provide play between the cutting blade 42, intermediate connection 102, and slot 82.

Other embodiments could arrange the cutting blades 42 in other ways such that the tension in the wireline cable 18 can be transferred to the cutting blades 42 to provide the cutting force to break the wireline cable 18 from the wireline head 30 once the rope socket housing 38 is released from the wireline head 30.

As illustrated in FIGS. 2 and 3, an ECRD style actuator device 62 may be used to selectively operate the actuator device 62 between a first state in which the rope socket housing 38 is secured to the wireline head 30 and a second state in which the rope socket housing 38 is released relative to the wireline head 30. Other types of lock/unlock mechanisms or actuator devices 62 may be used to selectively release the rope socket housing 38 relative to the wireline head 30 and to cut the wireline cable 18. For example, the actuator device 62 could use a mechanical weak point (e.g., shear screws) or a motorized release device (e.g., a motor and "dog" could be used).

The present disclosure is not limited to use with wireline type cables. It can be used with other cable types, including "slickline" cables that do not carry electric, power, or data. For example, a mechanical weak point style actuator device 62 may be used with a slickline type cable to cut the cable.

It will be understood that certain features and sub combinations are of utility and may be employed without reference to other features and sub combinations. Features described and illustrated with respect to certain embodiments may also be implemented in other embodiments. This is contemplated by and is within the scope of the claims. Since other possible embodiments of the disclosure may be made without departing from the scope thereof, it is understood that examples herein described or shown in the accompanying drawings are to be interpreted as illustrative and are not intended to limit the concepts and principles of the present disclosure. Many changes, modifications, variations and other uses and applications of the illustrated examples will become apparent to those skilled in the art after considering the specification and the accompanying drawings. Such changes, modifications, variations and other uses and applications are deemed to be covered by the disclosure.

What is claimed is:

1. A cable cutting device for severing a cable configured to provide support in a well, the cable cutting device comprising:

a head including a ramped channel in an outer wall of the head;

a housing movable relative to the head and configured to be at least partially supported by the cable, the housing including a rope socket configured to engage an end of the cable;

a cutting blade supported by the housing and coupled to the ramped channel, the cutting blade further coupled to rollers that can roll along the ramped channel, and the cutting blade movable along the ramped channel as the housing moves relative to the head; and an actuator device for selectively securing the housing to the head, the cutting blade secured in an open position while the actuator device selectively secures the housing to the head, and the cutting blade biased to a closed position when the actuator device selectively releases the housing from the head.

2. The cable cutting device of claim 1, wherein a tension force in the cable biases the housing to move relative to the head.

3. The cable cutting device of claim 1, wherein the ramped channel is one of a plurality of ramped channels, and wherein the cutting blade is one of a plurality of cutting blades each pinned to a corresponding one of the plurality of ramped channels.

4. The cable cutting device of claim 1, wherein the ramped channel includes a lower end and an upper end, wherein the lower end is located a first radial distance from a central axis of the head and the upper end is located a second radial distance from the central axis of the head, and wherein the first radial distance is greater than the second radial distance.

5. The cable cutting device of claim 4, wherein the cutting blade is coupled to the lower end of the ramped channel when the actuator device selectively secures the housing to the head.

6. A cable cutting device for severing a cable configured to provide support in a well, the cable cutting device comprising:

a head;

a rope socket assembly configured to engage an end of the cable and configured to be at least partially supported by the cable, the rope socket assembly positioned within the head;

an actuator device for selectively securing or releasing the rope socket assembly relative to the head; and a cutting blade configured to cut the cable, the cutting blade secured in an open position when the actuator device selectively secures the rope socket assembly relative to the head, and the cutting blade biased to a closed position by a tension force in the cable when the actuator device selectively releases the rope socket assembly relative to the head, wherein the tension force in the cable biases the rope socket assembly in a first direction towards an upper end of the head, wherein movement of the rope socket assembly in the first direction biases the cutting blade to the closed position, wherein the rope socket assembly engages a linkage arm to bias the cutting blade to the closed position when the rope socket assembly moves in the first direction, and wherein the cutting blade is pivotally connected to the linkage arm, and a portion of the cutting blade engages a wall that forces the cutting blade to pivot closed as the linkage arm moves.

7. The cable cutting device of claim 6, wherein the rope socket assembly includes a rope socket and a rope socket housing, the actuator device selectively securing or releasing the rope socket relative to the head by selectively securing or releasing the rope socket housing relative to the head.

8. The cable cutting device of claim 7, wherein the actuator device includes a first portion fixed to the rope socket housing and a second portion fixed to the head, and wherein the first portion can be selectively secured to or released from the second portion.

9. The cable cutting device of claim 6, wherein the rope socket assembly is retained within the head when the rope socket assembly is released relative to the head, and wherein at least a portion of the cable is released from the head.

10. A cable cutting device for severing a cable engaging a rope socket assembly, the cable configured to provide support in a well, the cable cutting device comprising:

a head at least partially supported by the cable;

a first linkage arm pivotally coupled to the head;

a second linkage arm pivotally coupled to the rope socket assembly, the second linkage arm further pivotally coupled to the first linkage arm at an intermediate connection;

an actuator device selectively operable between a first state in which the rope socket assembly is secured relative to the head, and a second state in which the rope socket assembly is released relative to the head; and a cutting blade coupled to the intermediate connection, the cutting blade secured in an open position while the actuator device is in the first state, the cutting blade biased to a closed position while the actuator device is in the second state.

11. The cable cutting device of claim 10, wherein a tension force in the cable biases the rope socket assembly in a first direction towards an upper end of the head, and wherein movement of the rope socket assembly biases the intermediate connection radially inwards to move the cutting blade to the closed position.

12. The cable cutting device of claim 10, wherein the cutting blade has an elongated slot for coupling to the intermediate connection.

13. The cable cutting device of claim 12, wherein the cutting blade is received within a slot in the rope socket assembly such that movement of the rope socket assembly in a first direction towards an upper end of the head biases movement of the cutting blade in the first direction, wherein the elongated slot permits the cutting blade to move relative to the intermediate connection in a direction parallel to the first direction, and wherein the intermediate connection biases the cutting blade to move in a second direction perpendicular to the first direction.

14. The cable cutting device of claim 10, wherein the first linkage arm is pivotally coupled to the head at a first connection, wherein the second linkage arm is pivotally coupled to the rope socket assembly at a second connection, and wherein the second connection moves away from the first connection when the rope socket assembly moves in a first direction towards an upper end of the head.

* * * * *